US006640474B2

(12) United States Patent
Knoerzer et al.

(10) Patent No.: US 6,640,474 B2
(45) Date of Patent: Nov. 4, 2003

(54) TRADING CARD AND DISPLAY STAND

(75) Inventors: Anthony Robert Knoerzer, Plano, TX (US); Garrett William Kohl, Allen, TX (US); Rocco Dominic Papalia, Plano, TX (US)

(73) Assignee: Recot, Inc., Pleasanton, CA (US)

( * ) Notice: Subject to any disclaimer, the term of this patent is extended or adjusted under 35 U.S.C. 154(b) by 0 days.

(21) Appl. No.: 10/060,810

(22) Filed: Jan. 30, 2002

(65) Prior Publication Data

US 2003/0140535 A1 Jul. 31, 2003

(51) Int. Cl.[7] ..... G09F 27/00
(52) U.S. Cl. ..... 40/455; 40/544
(58) Field of Search ..... 40/455, 717, 906, 40/542, 544, 764

(56) References Cited

U.S. PATENT DOCUMENTS

| | | | | |
|---|---|---|---|---|
| 4,861,632 A | | 8/1989 | Caggiano | |
| 4,926,296 A | | 5/1990 | Blume et al. | |
| 5,067,063 A | | 11/1991 | Granneman et al. | |
| 5,268,827 A | | 12/1993 | Granneman et al. | |
| 5,365,686 A | * | 11/1994 | Scott | 40/455 |
| 5,480,156 A | | 1/1996 | Doederlien et al. | |
| 5,545,069 A | | 8/1996 | Glynn et al. | |
| 5,567,054 A | | 10/1996 | Dalgleish | |
| 5,641,164 A | | 6/1997 | Doederlein et al. | |
| 5,671,555 A | * | 9/1997 | Fernandes | 273/237 |
| 5,676,451 A | | 10/1997 | Tabanera | |
| 5,833,070 A | | 11/1998 | Mizuno et al. | |
| 5,841,878 A | * | 11/1998 | Arnold et al. | 381/124 |
| 5,860,724 A | | 1/1999 | Cheng | |
| 5,874,155 A | | 2/1999 | Gehrke et al. | |
| 6,050,010 A | * | 4/2000 | Garcia et al. | 40/124.02 |
| 6,205,690 B1 | * | 3/2001 | Heropoulos et al. | 40/544 |
| 6,292,780 B1 | | 9/2001 | Doederlein et al. | |
| 6,298,990 B1 | | 10/2001 | Amrod et al. | |

OTHER PUBLICATIONS

Technology Watch Article (1 page).
Seiko Precision Article entitled "Electro Luminescence" found at http://www.seiko–precision.com/html/el_co.htm (4 pages).
Amcon international Article entitled "LUXLED electro luminescence technique" found at http://www.amcon–lux-led.com/luxled/t echnic1.htm (11 pages).
WPI Light Emitting Diodes Article entitled "A growing number of application" found at http://www.worldprod-ucts.com/home/wpi/ppg/ell/e1102t.htm (8 pages).
Article entitled "MK3B Power Paper Cell" found at http:// www.powerpaper.com/techDataText2.html (1 page).
Drawing of Electrode found at http://www.powerpaper.com/ bat teryStructureText.html (1 page).
Article entitled "Membrane Switches & Graphic Overlays" found at http://www.flexetech.com/membrane.htm (2 pages).

(List continued on next page.)

*Primary Examiner*—Gary Hoge
(74) *Attorney, Agent, or Firm*—Colin P. Cahoon; Carstens, Yee & Cahoon, L.L.P.

(57) ABSTRACT

A trading card having an electroluminescent feature in combination with a display stand providing a power source. When the trading card is placed in the display stand, the power source from the display stand energizes the electroluminescent feature of the trading card, thereby providing illuminated graphics and making the trading card more interactive. The trading card can include a circuit that facilitates moving graphics displays and can further drive a speaker to allow for audio in conjunction with the illumination.

1 Claim, 2 Drawing Sheets

OTHER PUBLICATIONS

Home Page for Memtronik Innovations, including article on Membrane Switches, found at http://www.memtronik.com/start1.htm (8 pages).

Article entitled "Membrane Switches and Graphic Overlays That Perform as Well as They Look" found at http://www.metromark.com/membrane.html (1 page).

Article entitled "Electroluminescents" found at http://www.memtronik.com/start1.htm (6 pages).

Article entitled "Thin Film Rechargeable Lithium Battery" found at http://www.ornl.gov/ORNLTech/battery.html (2 pages).

Jan. 2001 Popular Science Article entitled "Paper Thin Power" (1 page).

* cited by examiner

TRADING CARD AND DISPLAY STAND

BACKGROUND

1. Technical Field

The present invention relates to a trading card, such as a baseball card, having electroluminescent features and a display stand having a means for illuminating such features. Electroluminescent material in a thin film is incorporated in the trading card. A display stand, having a power supply, provides current which energizes the electroluminescent film when the card is placed in the stand, thereby illuminating at least a portion of the graphics on the card.

2. Description of Related Art

The trading card industry has evolved and grown to become a major economic and cultural force in modem society around the world. Baseball cards, the first trading cards, originated in 1887. They were initially made from a cloth like material, and many were homemade by avid fans. As the popularity of the sport grew so did the interest in collecting cards. By the 1930's the production of cards occurred on a much broader scale. Baseball cards were packaged with chewing tobacco, Cracker Jacks™ and chewing gum. Three distinct sizes resulted from the various marketing/packaging techniques.

Major changes in the production of trading cards took place during the 1960's. A standard size for card production replaced the previous mixed sizes formerly available. The industry expanded allowing for the production of trading cards beyond baseball cards. Other sports cards, such as football, basketball, hockey, and soccer went into production. In the next few years, as trading cards continued to gain in popularity and the industry grew, non-sports cards were developed. Today, trading cards of almost every arena can be found, including cards of television characters, mathematicians, scientists, and historical events. The industry has grown to phenomenal proportions supporting trading card fan clubs, monthly magazines, books, and online chat groups.

Some changes in trading cards from 1980 to 1996 include the addition of insertion cards. Such cards are found only in a few unmarked packs or sets of cards. Their rarity increases the value of these cards. Redemption cards, which are included in one out of every 360 packs of cards, are another example of an industry change. These cards are redeemable by the manufacturer for a limited edition set. Premium cards with UV coatings were introduced to the industry in the 1990's. Such cards have a slick appearance. Holographic images superimposed onto cards give some cards the ability to offer changing appearances of the subject. Trading card games, developed from avid trading card enthusiasts have broadened the appeal of trading cards, as the industry as a whole continues to grow.

On Sept. 18, 2001, U.S. Pat. No. 6,292,780 B1 issued to Doederlein, et al. entitled "Talking Trading Card Player System" (hereinafter the '780 Patent). The '780 Patent describes previous attempts at making trading cards more interactive using bar codes or magnetic strips mounted on cards which can be scanned by reader devices for use in various applications. The '780 Patent (and its related predecessors U.S. Pat. Nos. 5,641,164 and 5,480,156) provides more extended audio capabilities with individualized trading cards. However, the '780 Patent teaches the use of the sound feature with standard, prior art graphics presentations. Consequently, the improvement in interactive nature of the card is merely an aural improvement and not a visual improvement.

A need exists for a further improvement to the trading card that allows for certain features of the trading card to illuminate and, if possible, simulate graphics movement or similar effects. It would also be desirable if the trading card was interactive with a base or holder, such that different trading cards generated different display characteristics when associated with such base or holder, such as a series of illuminations combined with an audio reproduction associated with said card. Such features could be used to make the cards more desirable, thereby making them valuable marketing tools in combination with other products.

SUMMARY OF THE INVENTION

The proposed invention comprises a trading card having electroluminescent features that can be placed in a display stand or other display means. The display stand contains a power supply and, optionally, a switch, speaker, and other necessary circuitry. The electroluminescent feature on the trading card comprises a thin film electroluminescent material. When the electroluminescent film is energized, the electroluminescent feature illuminates.

The trading card can also incorporate a thin film circuit that can control the illumination of several electroluminescent features on the card in series, thereby creating, for example, a motion effect on the card. The thin film circuitry can also interface with the base components to provide for an audio presentation associated with the particular trading card.

The features presented by the trading card and the base make a trading card that is desirable to the consumer and can be used in a number of marketing applications. For example, the base and a set of trading cards can be sold as a starting kit for collectors. Thereafter, trading cards can be given away as promotional prizes in various products, such as a bag of potato chips or other snacks.

The above as well as additional features and advantages of the present invention will become apparent in the following written detailed description.

DESCRIPTION OF THE DRAWINGS

The novel features believed characteristic of the invention are set forth in the appended claims. The invention itself, however, as well as a preferred mode of use, further objectives and advantages thereof, will be best understood by reference to the following detailed description of illustrative embodiments when read in conjunction with the accompanying drawings, wherein:

DETAILED DESCRIPTION

Figure 1:
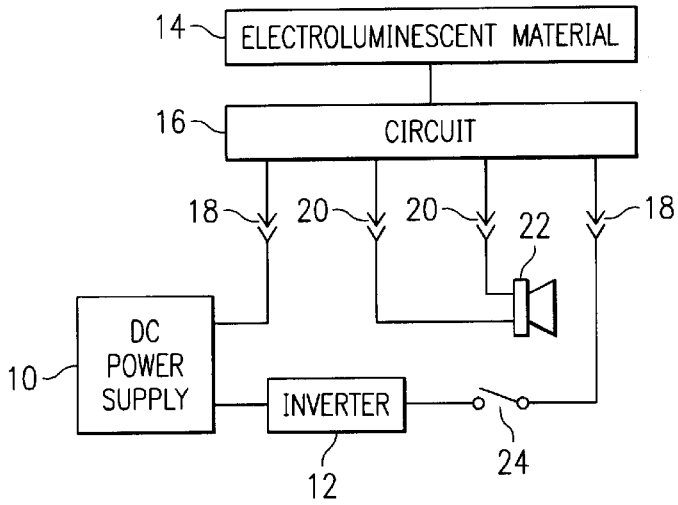
FIG. 1 is a schematic view of the electrical elements of the trading card and display stand of one embodiment of the invention.

FIG. 1 is a schematic showing the electrical components of one embodiment of the invention. A DC (direct current) power supply 10 provides the electrical power which, as will be explained in detail below, when converted to AC (alternating current) by means of an inverter 12, energizes an electroluminescent material 14. The DC power supply can be, for example, a standard 9-volt battery or any other battery that is commercially available for portable applications. In the alternative to a DC power supply 10 and inverter 12, the invention can also utilize an external AC power supply such as household current, provided that an appropriate voltage and current regulator, as known in the art, is used for the application described herein. The DC power supply 10 and inverter 12 (which is regarded in combination an AC power supply) are preferably located in the base of a display stand, as will be described further below. However, the DC power supply 10 and/or inverter 12 can also be contained within the trading card itself.

The electroluminescent material 14, along with a circuit 16, typically a thin film circuit, are components of the invention preferably found in the trading card that will be described in further detail in conjunction with FIGS. 2*a* and 2*b*. Electroluminescent material 14 when energized produces a visible light. This phenomena, referred to as electroluminescence, involves the production of a light resulting from the application of an electrical field to prepared phosphor powders sandwiched between sheet-metal electrodes. Electroluminescent films function with alternating current (AC). The voltage is applied between the front and the back electrode by way of an AC power source, and the phosphor particles are excited by the electric field, thereby producing a luminescent Companies such as Memtronic of Montreal, Canada, and SEIKO Precision of the United Kingdom manufacture electroluminescent material suitable for use with the instant invention.

The circuit 16 is preferably a thin film circuit located in the trading card (sandwiched between various layers of the card) or, alternatively, can be a larger circuit located in the base of the display stand, which will be described in further detail in conjunction with FIGS. 3*a* and 3*b*. Electrical connections 18 are provided between the power supply 10 and the electrical components of the trading card, namely the electroluminescent material 14 and the circuit 16. Additional electrical connections 20 connect the circuit 16 to an optional speaker 22, which, in a preferred embodiment, is located in the base of the display stand, but can also be incorporated in the card itself.

Also shown in FIG. 1 is an optional switch 24 that can be used to turn on and off the power supply 10. The switch 24 is optional, as the invention, in one embodiment, can operate such that the trading card completes the electrical circuit when placed in the card display. In fact, in its simplest embodiment, the invention presented only requires some AC power supply, either provided by a display stand or incorporated into the card, and an electroluminescent material in the trading card illustrated by FIGS. 2*a* and 2*b*.

Figure 2A:
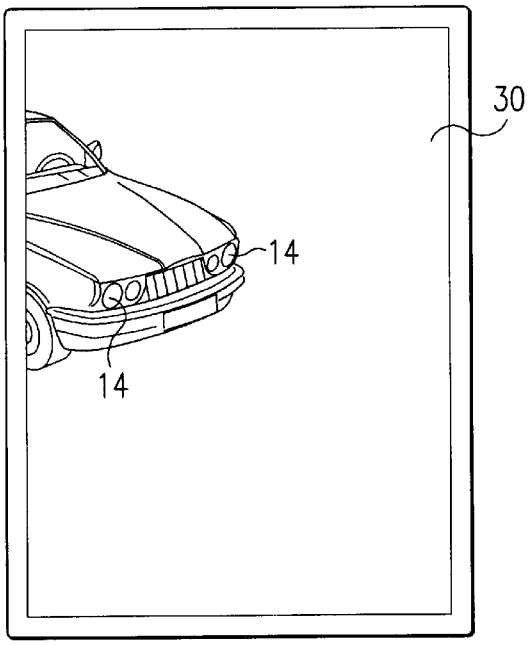
FIGS. 2*a* and 2*b* are front and rear views, respectively, in elevation of one embodiment of the trading card of the present invention.
Figure 2B:
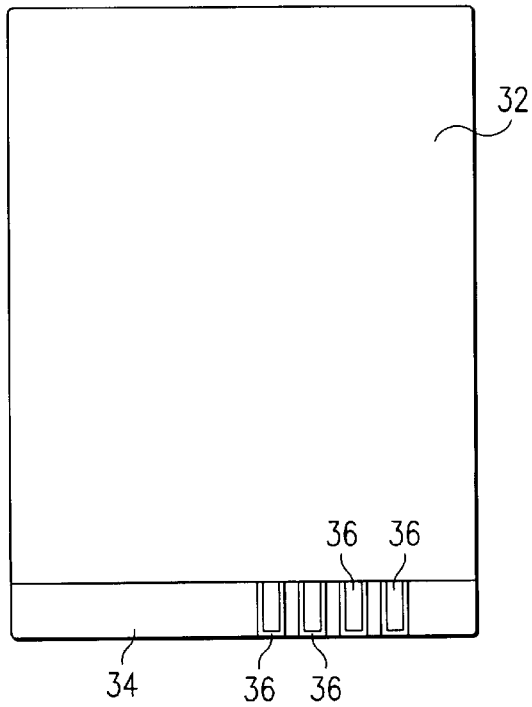

FIG. 2*a* shows a front view in elevation of an embodiment of a trading card of the invention, while FIG. 2*b* shows a rear view in elevation of the same card. Corresponding reference numerals are used to represent corresponding elements unless indicated otherwise throughout all figures. The trading card comprises a front layer 30 and a rear layer 32. The front layer 30 must be capable of a graphics presentation and is preferably constructed of a thin polymer film such as polyester. Polyester is preferred of its durability and scratch resistance, however other thin films such as OPP can be utilized. The rear layer 32 can optionally be capable of a graphics presentation, but need not necessarily have such capability. The rear layer 32 can again comprise a thin polymer film, or can alternatively comprise a more traditional paperboard construction. Paperboard or other material used to stiffen the card, as is known in the art, can also be sandwiched between the front layer 30 and the rear layer 32. Additional layers of polymer material, metal or metalized film, or other layers known in the art can likewise comprise or be incorporated between the front layer 30 and the rear layer 32.

The electroluminescent material 14 of the specific trading card depicted in FIGS. 2*a*and 2*b* is located graphically to illustrate a car with headlights that can light up on the front of the trading card. In a preferred embodiment of the invention, the electroluminescent material 14 is a layer of material below the front layer 30 and, thereby, sandwiched between the front layer 30 and the rear layer 32. When the electroluminescent material 14 is not energized, the headlights are dark and depicted by standard trading card graphics, such as a color pigment or ink. When the electroluminescent material 14 is energized, however, the headlights light up, thereby giving the appearance that the headlights have been turned on. It can be understood that such a simple feature immediately gives the card an interactive presentation. The color of the illumination of the example headlights can be controlled by selection of the electroluminescent material or by applying a layer of pigment or colored ink over the top of the electroluminescent material 14.

It should be understood that the interactive nature of the trading card can be enhanced by use of the circuit 16 described in FIG. 1. Specifically, the circuit can the illumination of various features on the trading card at, for example, specifically timed intervals. Such feature provides the trading card with the capability of illustrating motion. For example, referring to the car shown on FIG. 2*a*, electroluminescent material depicting the entire car in various successive positions can be embedded into the card such that only a first image position is visible when the electroluminescent material is not energized. Once the electroluminescent material is energized, the various car positions can be illuminated in succession, thereby giving the illusion of the car moving across the face of the card. It should be understood that any number of items on the face of the trading card can be designed into the card and illuminated in series or at random to provide limitless possibilities for different graphics presentations. A trading card that depicts scenery can illuminate to depict a lightning storm and rain showers. A short clip from a popular scene from a movie can be recreated using electroluminescent points on the card that are energized in a predetermined pattern. An event from a sports celebrity's past performance, such as hitting a home run in a baseball game, can be recreated on the card.

The back side of the trading card illustrated in FIG. 2*b* shows a rear layer 32 that is slightly shorter than the front layer 30, thereby exposing a portion 34 of a layer located immediately beneath the rear layer 32. This exposed portion 34 allows for access to contact strips 36 that, in combination with corresponding contact elements 38 illustrated in FIG. 3a, provide for the connections 18, 20 previously discussed with regard to FIG. 1. This is accomplished when the contact strips 36 and contact elements 38 mate when the card is placed in the display stand shown in FIGS. 3*a* and 3*b*. These contact strips 36 can be thin resilient metal strips affixed to a layer of the trading card. the contact strips 36 are electrically connected to the circuit (not shown in FIG. 2*b*) which is sandwiched between the front layer 30 and the rear layer 32. In turn, the circuit is electrically connected to the electroluminescent material 14. Four contact strips 36 are shown in FIG. 2*b* but any appropriate number, two or more, can be used depending on the number required for any given embodiment.

Figure 3A:
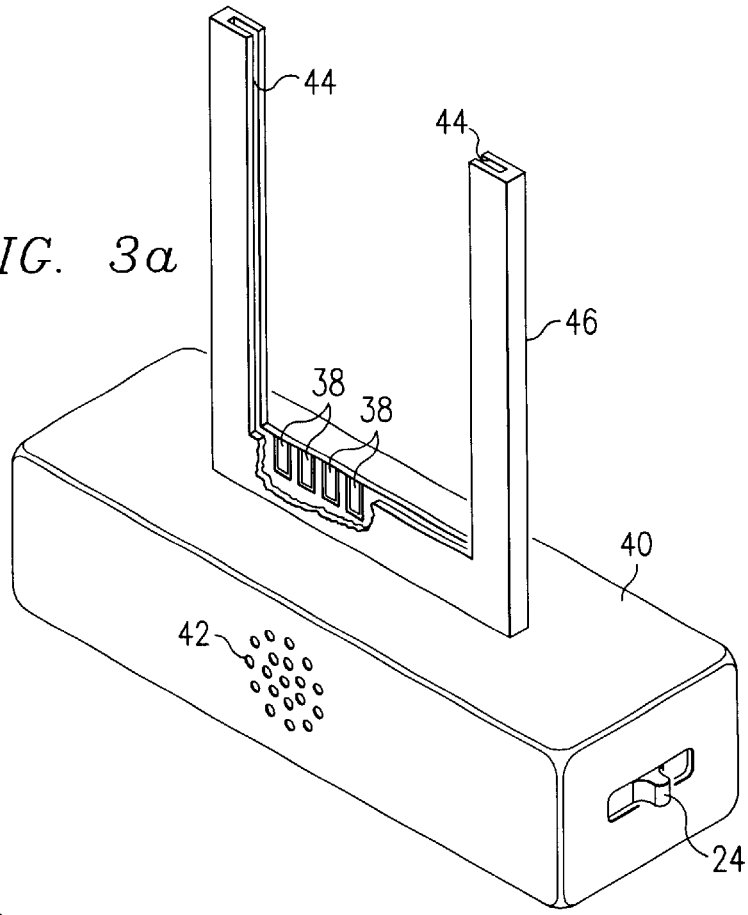
FIG. 3*a* is a perspective view, partially cut away to expose connecting elements, of the display stand of one embodiment of the present invention.

FIG. 3*a* illustrates one embodiment of a display stand for holding the trading card of the present invention. This stand comprises a base 40 in which, in one embodiment, is located the DC power supply (for example, a 9-volt battery), inverter, and optional speaker and switch 24. The speaker, while not shown, is mounted behind an audio port 42. The base 40 is integral with or attached to a card receiving section or element 46. This card receiving section 46 has a card receiving channel 44 in which the trading card can be placed. The dimensions of the receiving section 46, including the dimensions of the channel 44, should correspond with the thickness, width, and length of the trading card to be used with the stand. A portion of the receiving section 46 is shown cut away in FIG. 3*a* in order to illustrate the contact elements 38, preferably a thin metal construction, that, when used in combination with the contact strips 36 on the trading card as illustrated in FIG. 2*b*, form the connections 18, 20 shown in FIG. 1. The contact elements 38 are electrically connected to the power supply, which is preferably located in the base 40.

Figure 3B:
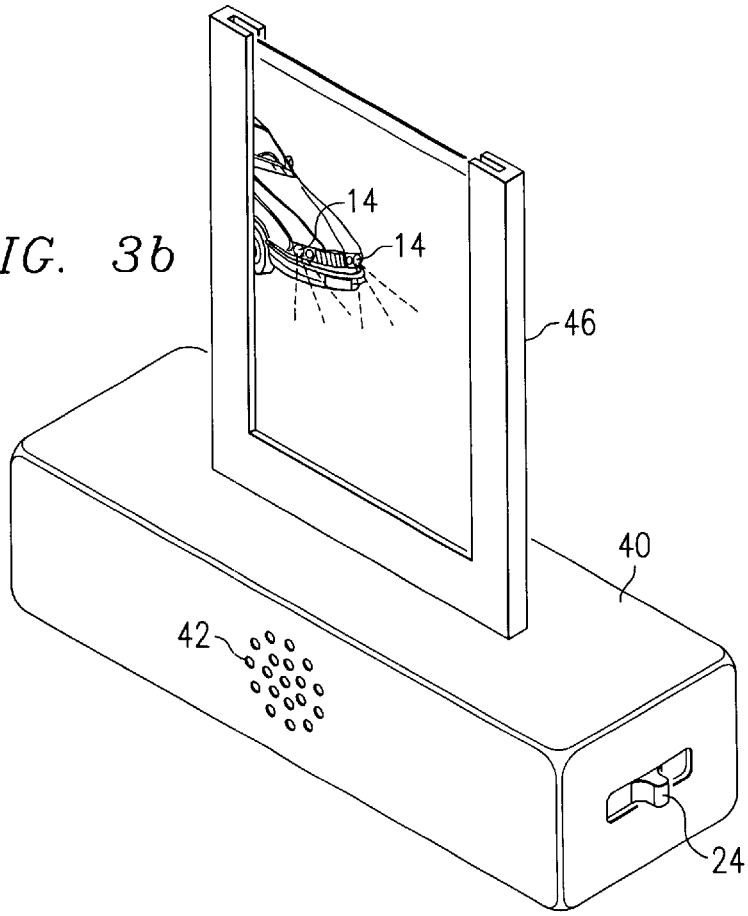
FIG. 3*b* is a perspective view of the display stand with card installed of one embodiment of the present invention.

FIG. 3*b* shows a trading card placed in the receiving section or element 46. Also shown is the optional switch 24. When such switch 24 is placed in the on position, the electroluminescent material 14 is energized and illuminates. Turning on the switch can also, as previously described, set off a series of illumination, controlled by the circuit found in the card, that gives the trading card an appearance of motion or other interactive effect. Audio data can be stored on the circuit within the card or on other thin film memory devices, as known in the art, located within or on the card. Such data can be converted to an audio signal, by means known in the art, and played on the speaker found within the base 40 in order to provide audio characteristics to the trading card and display as well. These features give the trading card an increased interactive presentation, making the cards more desirable as collector items.

It should be understood that the particular configuration of the trading card base can be of any number of designs for both a stationary and portable base. The trading card and base can be sold and marketed in combination as a kit. In addition, the individual components of the invention, the trading card and base, can be sold or provided separately. For example, trading cards, either individually or in sets, can be included as a promotional item with a food product, such as inside a chip bag. Promotional material on the chip bag can also provide information to the consumer on how to purchase the stand in either a retail setting or by mail or other such means through a supplier. Once a consumer has at least one stand, any number of different trading cards having the electroluminescent features described herein can be used with the same stand.

While the invention has been particularly shown and described with reference to a preferred embodiment, it will be understood by those skilled in the art that various changes in form and detail may be made therein without departing from the spirit and scope of the invention.

We claim:

1. A card display system, comprising:

a stand having a power supply and designed to receive a card, the card including electroluminescent material, the electroluminescent material illustrating an image in a plurality of positions;

a circuit to direct illumination of the electroluminescent material such that the plurality of position are illuminated in a pattern;

wherein the pattern is randomly generated.

* * * * *

UNITED STATES PATENT AND TRADEMARK OFFICE

CERTIFICATE OF CORRECTION

PATENT NO. : 6,640,474 B2
DATED : November 4, 2003
INVENTOR(S) : Knoerzer et al.

It is certified that error appears in the above-identified patent and that said Letters Patent is hereby corrected as shown below:

Column 6,
Line 29, delete “circuit to” and insert -- circuit connected to --

Signed and Sealed this

Thirtieth Day of December, 2003

JAMES E. ROGAN
*Director of the United States Patent and Trademark Office*